United States Patent [19]

Aboulafia et al.

[11] 4,069,287

[45] Jan. 17, 1978

[54] PROCESS FOR THE PRODUCTION OF POLYOLEFIN FIBERS

[75] Inventors: Joseph Aboulafia; Richard Le Fustec, both of Le Havre; Claude Schranz, Harfleur, all of France

[73] Assignees: Compagnie Francaise de Raffinage; Groupement Europeen de la Cellulose, Paris, France

[21] Appl. No.: 708,067

[22] Filed: July 23, 1976

Related U.S. Application Data

[63] Continuation-in-part of Ser. No. 545,830, Jan. 21, 1975, abandoned.

[30] Foreign Application Priority Data

July 25, 1975 France ..... 75 23297
Jan. 31, 1974 France ..... 74.3388

[51] Int. Cl.[2] ..... D21F 11/00

[52] U.S. Cl. ..... 264/140; 162/157 R; 264/13; 264/204; 528/502

[58] Field of Search ..... 162/157 R; 264/13, 14, 264/140, 205, 204; 528/502

[56] References Cited

U.S. PATENT DOCUMENTS

| | | | |
|---|---|---|---|
| 3,549,732 | 12/1970 | Rice | 264/8 |
| 3,719,648 | 3/1973 | Frielink | 264/143 |
| 3,902,957 | 9/1975 | Kotlowski | 162/157 R |

FOREIGN PATENT DOCUMENTS

| | | | |
|---|---|---|---|
| 47-32131 | 8/1972 | Japan | 162/157 R |

*Primary Examiner*—Jay H. Woo
*Attorney, Agent, or Firm*—Curtis, Morris & Safford

[57] ABSTRACT

A process and apparatus for manufacturing polyolefin fibers from a composition of the said polyolefins dissolved in a diluent, by subjecting the composition to flow at a velocity above a critical value in a tube or bundle of tubes, the temperature of the composition being within the range of critical temperatures of the said composition over at least a portion of the length of the tube or bundle of tubes and separating the fibers from the liquid diluent. The critical temperature range is below the temperature of solution of the polyolefin in the molten state in a diluent and is more specifically the range of temperatures in which the polyolefin remains in dissolved condition when the solution mixture is maintained at rest but precipitates when the mixture is subjected to certain disturbances such as, for instance, shearing. This typically is between 70° and 130° C. The lower limits of the critical velocity and the critical temperature are determined by the appearance of undesired powder co-precipitating with the fibers.

In a variation the composition contains fibrous material (e.g. cellulose) insoluble in the diluent, yielding an interlaced fiber mix (useful in paper making, among other things).

In a further improvement to avoid formation of "nodules" (i.e. random agglomerations of fibers), said tube(s) is provided with at least one restriction decreasing the cross-section of the tube(s); e.g. by a diaphragm, conical nozzle, very short inner tube, etc.

17 Claims, 5 Drawing Figures

Figure 1:
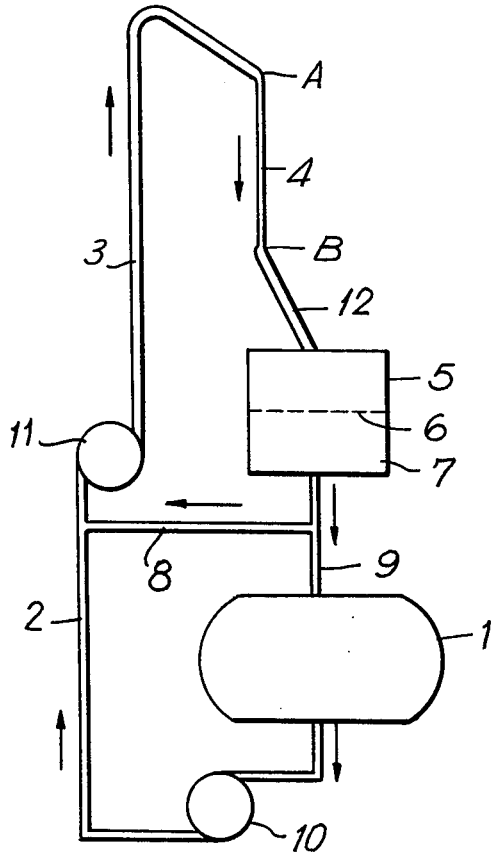

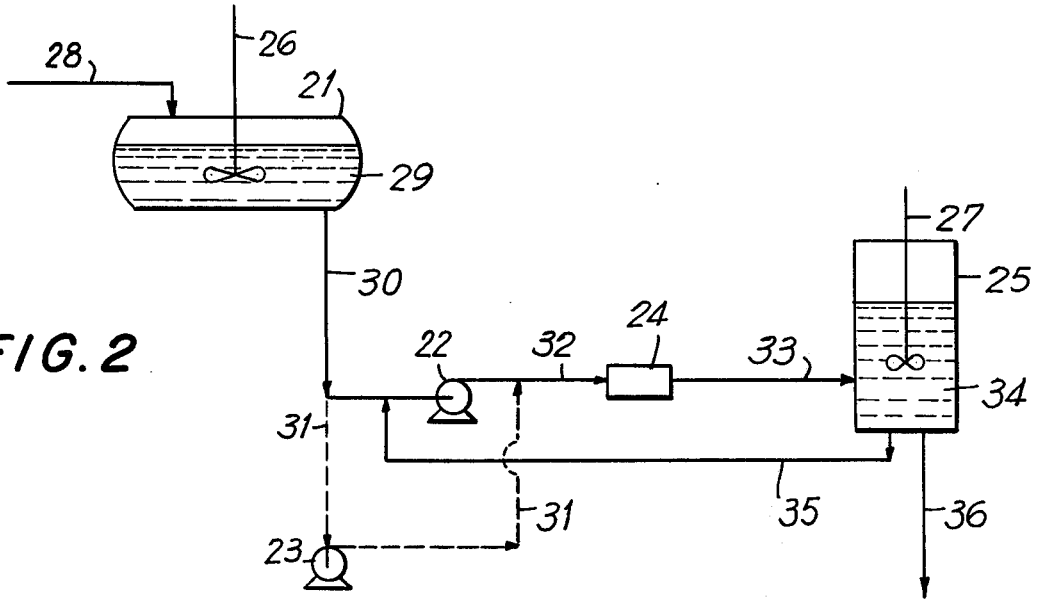
FIG. 2
FIG. 3
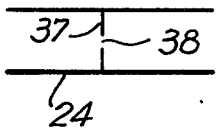
FIG. 4
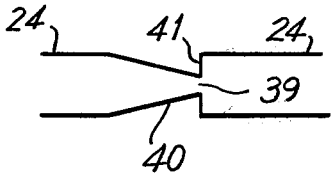
FIG. 5
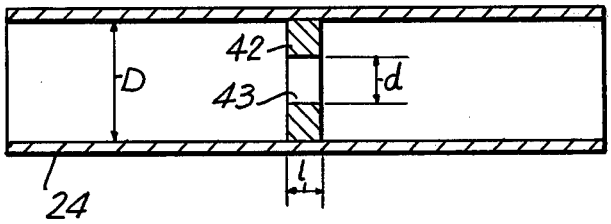

PROCESS FOR THE PRODUCTION OF POLYOLEFIN FIBERS

This application is a continuation-in-part of Ser. No. 545,839 filed Jan. 21, 1975 and now abandoned.

The present invention relates to a new process of manufacturing polyolefin fibers from a solution of these polyolefins.

French Pat. Nos. 1,596,107 and 2,141,748 describe processes for the manufacture of polyolefin fibers by adiabatic expansion of a solution of polyolefins. This expansion takes place by passage of the solution through a spinneret. The solvent is at least partially volatilized and the fibers are then collected.

French Pat. No. 2,132,903 concerns the preparation of polyolefin fibers of high molecular weight by dispersing a solution of polyolefins under a high shearing rate in a precipitant. The polyolefin solution, before being introduced into the precipitant, must be at a temperature above the temperature of dissolving of the molten mass of the polyolefins. In one particular embodiment of this process, the solvent and the precipitant are the same chemical substance.

French Pat. No. 2,181,952 describes a process for precipitating polymer fibers from a solution of said polymer by introducing a stream of solvent tangentially to the outer surface of the precipitation enclosure. The shearing of the solution created by the rotation in the enclosure produces the precipitation of the polymer in fiber form.

French Pat. No. 2,131,145 describes a process for obtaining fibrous gel containing 30% polyolefins or more by weight by polymerization of olefins, the reaction mixture being subjected to a shearing force created by mechanical agitation. The fibrous gel may also be obtained by cooling a solution of a preformed polymer under a high shearing rate created by mechanical agitation, said solution being initially at a temperature above the temperature of solution of the molten mass of the polyolefin.

An advantage of the present invention is the development of a process for the formation of polyolefin fibers which is not accompanied by the vaporization of a solvent and which does not require the use either of a precipitant or of means of mechanical agitation intended to create a high rate of shear in the solution.

The applicants discovered that polyolefin fibers are obtained when a composition consisting of a polyolefin and a diluent flows under special conditions and when the temperature of the composition is within certain limits.

Therefore a preferred embodiment of the present invention is a process for the manufacture of polyolefin fibers from a composition of said polyolefins dissolved in a diluent. Said process comprises subjecting the composition to flow, at a velocity higher than a critical value, in a tube or bundle of tubes, the temperature of the composition being within a range of critical temperatures of said composition over at least a portion of the path of the tube or bundle of tubes and by separating the fibers from the liquid diluent.

A further embodiment of the present invention is apparatus for carrying out of the process of the invention, which apparatus will be described in detail further below in the present application.

The invention is not limited to obtaining fibers from a macroscopically homogeneous liquid composition. The applicants have also carried out the process by cooling a polyolefin composition in a diluent containing furthermore fibers which are insoluble in the diluent. Thus, from a polyolefin composition dissolved in cyclohexane and furthermore containing cellulose fibers. This particular application of the process for the manufacture of polyolefin fibers forms another object of the invention.

The applicants, in the continuation of their work, have further found that in certain cases the new process described above may lead, not only to independent fibers which are well separated from each other, but also to random agglomerations of these fibers in the tube or bundle of tubes in which the fibers precipitate. This is probably due to the difference in the speeds of travel of the polyolefin solution and the precipitated fibers. As a matter of fact, the fibers which have already formed do not have time to flow before other fibers precipitate. At times, the result obtained is, so to speak, a sheath of fibers. The applicants suggest this hypothesis without claiming it actually to be the cause of the phenomenon described, and do not so limit themselves.

When such sheaths of fibers have been obtained, the synthetic papers of which the said fibers may be used to form a part may then present agglomerates of fibers commonly referred to as "nodules." These are undesirable, since they lead to a heterogeneous appearance—and quality — of the paper.

A further object of the present invention is, therefore, to eliminate this drawback and to make it possible to obtain well-dispersed fibers.

A further preferred embodiment of the present invention is therefore a process of manufacturing polyolefin fibers as described above wherein that said portion of the path of the tube or bundle of tubes in which the temperatures of the said composition is within the range of critical temperatures of the said composition comprises at least one restriction.

Still another embodiment is apparatus for the carrying out of this improved process, which apparatus will also be described in detail below.

The fibers obtained by the foregoing processes of the present invention constitute still another embodiment of the invention.

Finally, the use of the fibers for the manufacture of papers in accordance with known techniques and the papers thus obtained also constitute embodiments of the invention.

In order to define the zone of critical temperatures which is characteristic for the process of manufacturing polyolefin fibers in accordance with the invention, it is necessary first of all to define the temperature of solution of a polyolefin in molten state.

By temperature of solution of the polyolefin in molten state in a diluent is meant the temperature at which upon heating a macroscopically homogeneous phase of the molten polyolefin in the diluent appears. It is known that one does not have a true solution at this temperature and that one would tend towards a true solution by increase in the temperature, such increase being furthermore accompanied by an increase in the viscosity of the composition.

The temperature of solution of the polyolefin in molten state in a diluent obviously depends on the polyolefin, on the diluent, and on the concentration of the polyolefin in the diluent.

The range of critical temperatures is a range of temperatures lower than the solution temperature previously defined. Typically, it is between 70° and 130° C. It is the range of temperatures in which the polyolefin remains in dissolved condition when the solution mixture is maintained at rest but precipitates when the mixture is subjected to certain disturbances such as, for instance, shearing. The amplitude of the range of critical temperatures depends on the polyolefin, on the diluent, on the concentration of the polyolefin in the diluent, and on the velocity of flow of the mixture. The range may extend over 1° to 10° C for solutions of polyethylene of a density of more than 0.935, for example.

The restriction of the improved embodiment of the present invention functions within the same range of critical temperatures.

The critical phase of the process for the manufacture of fibers is the flow under specific conditions of the composition at a temperature which must be within the range of critical temperatures or possibly slightly above the upper limit of the range of critical temperatures when said flow is accompanied by heat losses.

When it is desired to obtain only fibers, the velocity of flow of the composition must be greater than a critical value which depends on the nature of the polyolefin, on the nature of the diluent, and on the concentration of the polyolefin in the diluent. Within this critical value of the velocity, a mixture of polyolefin fibers and powder is obtained.

One simple method is to effect this flow in a tube or a bundle of tubes. The flow may be isothermal of nonisothermal. If it is isothermal, the temperature of introduction of the composition into the tube or bundle of tubes must be within the range of critical temperatures. If the flow is nonisothermal, the tube or the bundle of tubes then operates as heat exchanger, cooling the composition. The temperature of introduction of the composition may then be above the range of critical temperatures. In this latter case it is advantageous for the cooling to be effected homogeneously within the composition by the use of a bundle of tubes. The composition may or may not flow at a velocity greater than the critical value in a linear tube or bundle of tubes. The length of the tube or tubes is not determinative for the obtaining of the fibers. The "useful" length is the length at which the compostion is within the range of critical temperatures.

The velocity necessary for the formation of the fibers may be reached in several ways. A first manner consists in initially impressing this velocity on the composition by means of a circulating pump, the circulation line being of constant diameter. A second method consists in obtaining this velocity by a decrease in the cross section of the line downstream of the pump circulating the composition. In this latter case, only the portion of the line which is of reduced diameter, and which may be a tube or a bundle of tubes, will be the place of the formation of fibers. It should be noted that everything else being equal, the larger number of tubes which a bundle has, the smaller the diameter of the tubes must be.

The temperature at which the fibers are formed is generally obtained by decrease, in accordance with any means and velocity, starting from the temperature of solution of the polyolefin in molten state. This is particularly the case when the polyolefin from which one starts is initially in the form of powder or granulates which are dissolved in a diluent.

By the word "restriction" as used herein is to be understood a decrease in the cross section of passage of the polyolefin composition. This decrease may for instance be obtained:

by means of a diaphragm arranged in the flow tube for the composition, by means of a conical nozzle, by means of a very short tube of an inside diameter which is smaller than the flow tube for the composition, by means of a combination of several of these arrangements, and, in particular, a plate perforated with orifices which is equivalent to the presence of a plurality of diaphragms.

This restriction must, therefore, in accordance with the process of the invention, be located in the range of critical temperatures of the polyolefin composition.

In this specification and the accompanying drawings of the installation used, we have shown and described various preferred embodiments of our invention and have suggested various alternatives and modifications thereof; but it is to be understood that these are not intended to be exhaustive and that many other changes and modifications can be made within the scope of the invention. These suggestions herein are selected and included for purposes of illustration in order that others skilled in the art will more fully understand the invention and the principles thereof and will thus be enabled to modify it and embody it in a variety of forms, each as may be best suited to the conditions of a particular use.

FIG. 1 is a schematic drawing of a preferred embodiment of the present invention;

FIG. 2 similarly shows an alternative embodiment adapted to incorporate a restriction (within the meaning of the present invention);

FIGS. 3, 4 and 5 illustrate embodiments of and restrictions useful in the overall structure diagramed in FIG. 2.

Referring first to FIG. 1, an enclosure 1 containing a polyolefin in a diluent under a nitrogen pressure of 3 bars is connected, via the lines 2 and 3, to a straight tube 4 having ends A and B. The tube 4, which is the place of formation of the fibers, has a cross section which is less than that of the lines 2 and 3. Downstream of the tube 4 there is an enclosure 5 for the recovery of the fibers, which enclosure has a grid 6 on which the fibers deposit. The diluent is recovered in the lower portion 7 of the enclosure 5. A part of the diluent recovered is recycled via the line 8 while another part is forwarded, via the line 9, into the enclosure 1 when the latter is used as a solution enclosure for the polyolefin. The recycling through the line 8 can be eliminated when the diluent recovered at 7 does not contain any polyolefin.

The lines 2 and 3 contain pumps, 10 and 11 respectively. The pressure in the enclosure 5 is 3 bars. The loss of heat in the tube 4 depends upon the geometry of this tube and the material of which it is made. The formation of the fibers in the tube 4 takes place in a quasi-isothermal manner. The temperature of the composition at the point A is therefore substantially the same as at the point B, which means that the temperature of the composition at the point A is within the region of critical temperatures. The enclosure 5 is advantageously at the same temperature as the tube 4. The line 12 extending between the point B and the enclosure 5 may be eliminated, the tube 4 then discharging directly into the enclosure 5. Likewise, the end A may be connected directly to the outlet of the circulating pump 11. The carrying out of the process may require the use of a cooler (not shown in the figure) in the path of the line 2 or of the line 3 in the event that the temperature of the composition at the point A, in the absence of such cooler, would be above the upper limit of the range of critical temperatures and there is no, or practically no, heat loss in the tube 4.

In FIG. 1, the enclosure 5 fulfills the function of receiving the solution containing the fibers after their precipitation in the tube 4, as well as the function of recovering these fibers by filtration through the grid 6. However, it is possible to carry out these two functions in two different enclosures — a first enclosure which receives the solution and the fibers which it contains and permits the recycling of the solution to the precipitation tube; a second enclosure, fed continuously or intermittently, from the first enclosure via a line, effecting the recovery proper of the fibers (for instance by filtration). The filtrate recovered in the second enclosure is then sent to the polymer solution enclosure or is possibly recycled in the precipitation tube.

In another embodiment of the process, the temperature of the composition at the point A is above the upper limit of the range of critical temperatures. In this case it is necessary for there to be heat losses in the tube or bundle of tubes where the fibers are formed. This tube or bundle of tubes operates as a heat exchanger cooling the composition to a temperature within the range of critical temperatures. In this case also the line for the introduction of the composition into the tube or bundle of tubes may possibly contain a cooler.

The process may also be carried out in intermediate manner, that is to say in the presence of a tube or bundle of tubes producing only a small heat exchange. In this case, the solution will be introduced into the heat exchanger at a temperature within the range of critical temperatures or very close to the upper limit of said range.

When the tube or bundle of tubes acts as a heat exchanger, the jacket in which the heat-removing fluid flows may be formed of a single chamber or of several separate chambers fed with heat-removing fluids at the same temperature or at different temperatures.

The polyolefin subjected to the process of the invention may be polyethylene of a density of more than 0.935 obtained by the low-pressure polymerization process and whose molecular weight distribution may be very broad (for instance polyethylene of a density of 0.950 and for which $M_n$ is 8300 and $M_w$ is 300,000) or the molecular weight distribution of which is narrower (polyethylene of a density of 0.960 and for which $M_n$ is 11,500 and $M_w$ is 80,000). Polyethylenes of very high molecular weight may also be used. Crystalline polyolefins may also be used such as polypropylene or polybutene. The copolymers of olefins may also be subjected to the process of the invention.

The diluent used may be a solvent whose solubility parameter is preferably close to that of the polyolefin. In the case of polyethylene, one such solvent is commercial hexane or cyclohexane or mixtures of xylenes. However, the solubility parameter of the diluent may also be substantially different from that of the polyolefin.

The concentration of the polyolefin in the diluent is a parameter which has an effect on the position and amplitude of the range of critical temperatures. By way of example, in the case of polyethylene of a density of more than 0.935, the concentration of the polyolefin may vary between 0.5% and 10% of the weight of the diluent.

One can operate with a higher concentration of polyolefin; however, the compositions become more viscous and the mechanical energy which must be expended for the circulating of the composition becomes substantial.

It is also possible to add soluble adjuvants to the diluent, such as polyisobutylenes of low molecular weight or polyvinyl alcohol. These adjuvants do not precipitate upon the formation of the polyolefin fibers. The concentration of the adjuvants may be between 0.1% and 50% of the polyolefins. These adjuvants are added in order to increase the viscosity of the composition, which generally gives fibers that can be more easily separated from each other.

The process of the invention makes it possible to prepare fibers of a length of between 0.1 mm and 2 cm and of a diameter of more than 5 $\mu$, and typically less than 200 $\mu$. This last value does not correspond to the diameter of an individual fiber obtained by the process but to the diameter of bundles of individual fibers formed. The average diameter of the fibers obtained is in general between 10 $\mu$ and 50$\mu$. When using the restriction, the fibers formed are very individual ones and do not tend to agglomerate, because they are quickly ejected from the restriction. This of course does not exclude the presence of fibers of a larger diameter.

The fibers obtained by the process of the invention may find numerous industrial applications. They may in particular be used for the making of non-woven sheets, or as aggregates for adsorption of hydrocarbons or aqueous products. Furthermore, as indicated above, the polyolefin fibers obtained in accordance with the invention may be used alone or in mixtures with cellulose fibers for the manufacture of different papers in accordance with known techniques.

The invention is further illustrated by the following examples, given solely by way of illustration.

EXAMPLE I 28 g of polyethylene marketed under the name "VESTOLEN 6016" having the properties $d = 0.960$, $M_n = 11{,}500$, $M_w = 80{,}000$ are dissolved in an enclosure of a volume of 1 liter at a temperature of 130° C in 600 ml of cyclohexane, corresponding to a concentration of 5% expressed by weight. The enclosure is connected, via a reciprocating pump, to a copper coil of a length of 10 m and a diameter of 4 mm placed in a thermostatic oil bath in such a manner that the flow in the coil is isothermal. The temperature of the coil is therefore fixed. For a pumping rate of 70 liters/hour (which corresponds to a maximum linear velocity of the composition in the coil of 3 m/sec), fibers appear in the composition while it passes through the coil when the temperature of the composition at the entrance to the coil is between 82 and 78° C. These two values of the temperature define the range of critical temperatures.

When the temperature is above 82° C, all other things being equal, one does not note any precipitation of polyethylene in any form whatsoever.

When the temperature is below 78° C, all other things being equal, there is noted the precipitation of a mixture of fibers and powder, the proportion of powder being higher the lower the temperature.

Within the same temperature range when the rate of the pump is fixed at 35 l/hour (which corresponds to a maximum linear velocity of 1.5 m/sec of the composition in the coil), the fibers obtained are shorter, and they are obtained mixed with powder. The velocity is therefore below the critical value.

EXAMPLE II

An apparatus similar to that described in Example I in which the copper coil of a length of 10 m is replaced by a linear Teflon tube of a length of 40 cm and a diameter of 1.5 mm is fed with a solution formed of 2% polyethylene (identical to that described in Example 1), 1% Oppanol B (polyisobutylene of low molecular weight marketed by B.A.S.F.), and 97% commerical hexane. It is noted that the range of critical temperatures extends from 93° C to 97° C.

EXAMPLE III

An apparatus similar to that of Example I in which the copper coil of a length of 10 m is replaced by a linear steel tube of a length of 40 cm and a diameter of 2 mm is fed by a composition formed of 1% polyethylene (identical to that described in Example I), 1% of cellulose fibers and 98% cyclohexane.

It is noted that the range of critical temperatures extends from 78° C to 83° C, in which range an intermeshing of polyethylene and cellulose fibers is obtained.

EXAMPLE IV

A composition formed of 1% polyethylene (identical to that described in Example I), 0.5% cellulose fibers and 98.5% cyclohexane is treated in accordance with Example III. The range of critical temperatures is between 78° and 82° C.

EXAMPLE V

In an enclosure of a volume equal to 2 liters, 110 g of polypropylene marketed under the trade name "MOPLEN Q 30 P" and having the following properties:

—$M_n$ 28,000

—$M_w$ 450,000

-Proportion of atactic polypropylene 5.3%, are dissolved at the temperature of 140° C in 1.5 liters of heptane, which corresponds to a concentration by weight of 5%. The enclosure is connected, via a reciprocating pump having a rate of flow of 70 1/hour, with a linear tube of stainless steel of a length of 40 cm and a diameter of 2 mm. Fiber intermeshings are obtained for the range of critical temperatures of 80 to 88° C.

EXAMPLE VI

By means of a reciprocating pump of a rate of flow of 70 1/hour, a 5% solution of polyethylene identical to that described in Example I in commercial cyclohexane is passed into a tube of a length of 90 cm and a diameter of 2 mm provided with an outer jacket formed of three independent successive chambers of lengths of 20, 30, and 40 cm respectively. This device makes it possible to circulate a fluid at a desired temperature in each of the chambers constituting the outer jacket. The chamber whose length is equal to 20 cm surrounds the initial part of the tubes. The chambers of 30 and 40 cm in length surround the central portion and the final portion of the tube respectively.

The formation of fibers is noted within a range of critical temperatures of between 80° and 92° C. The temperature of the fluid circulating in the chamber surrounding the initial, central and final regions of the tube being equal to 125° C, 67° C and 67° C respectively.

EXAMPLE VII

A 5% solution of the same polyethylene in an industrial solvent having the composition:

| | |
|---|---|
| −49.4% | normal hexane |
| −19% | 3-methyl pentane |
| −18.9% | 2-methyl pentane |
| −7.8% | methyl cyclopentane, 2,2-dimethyl pentane and 2,4-dimethyl pentane |
| −4.9% | miscellaneous |

is passed into an apparatus identical to that described in Example VI.

The formation of fibers is noted in a range of critical temperatures of between 95 and 102° C. The temperature of the fluid flowing in the chamber surrounding the initial, central and final portions of the tube being equal to 200°C, 90° C and 90° C respectively.

EXAMPLE VIII

Sheets of laboratory paper ("formettes") were prepared using a mixture of cellulose fibers and polyethylene fibers prepared in accordance with the invention.

Bleached coniferous Kraft pulp was beaten in the laboratory to a degree of beating of 45° SR (degree Schopper Riegler, AFNOR Specification NF-Q 50-003). To this pulp there were added polyethylene fibers which had been previously disintegrated in the dry state. The composition obtained (60% polyethylene fibers; 40% wood pulp) had an SR degree of 30 and made it possible to produce formettes with a Rapid Kothen apparatus, being careful not to aerate the suspension. After drying, these sheets were heat-sealed without pressure in an oven at 136° C for 15 minutes.

The physical characteristics of these sheets were measured in accordance with the AFNOR specifications. The results are indicated in the following Table I, as compared with a composition of cellulose fibers of coniferous woods and broadleaved woods. They relate to formettes of 70 g/m².

TABLE I

| | | At 20° C with 65% relative humidity | | | | | | At 20° C in wet state (80 part of water to 20 parts of solid | |
|---|---|---|---|---|---|---|---|---|---|
| Composition | °SR | Permeability to air (cm³/s) | Bulk (cm³/g) AFNOR specification NF.Q 03-017 | Opacity to printing AFNOR specification NF. Q 03-024 | Breaking length (m) AFNOR specification NF.03-004 | Bursting AFNOR specification NF.Q 03-053 | Tearing AFNOR specification NF.Q 03-011 | Breaking m | Elongation % |
| Bleached pulp of broadleaved: 60% coniferous: 40% Bleached pulp of coniferous: 40% Polyethylene fibers in accordance with | 31 | 9 | 1.51 | 78 | 4,400 | 34 | 100 | 370 | 0 |

TABLE I-continued

| Composition | °SR | At 20° C with 65% relative humidity: Permeability to air ($cm^3/s$) | Bulk ($cm^3/g$) AFNOR specification NF.Q 03-017 | Opacity to printing AFNOR specification NF. Q 03-024 | Breaking length (m) AFNOR specification NF.03-004 | Bursting AFNOR specification NF.Q 03-053 | Tearing AFNOR specification NF.Q 03-011 | At 20° C in wet state (80 part of water to 20 parts of solid: Breaking m | Elongation % |
|---|---|---|---|---|---|---|---|---|---|
| the invention: 60% | 30 | 70 | 2.8 | 80 | 2,400 | 19 | 120 | 1,000 | 4 |

These results show that under the operating conditions of the example the polyethylene fibers in accordance with the invention make it possible to obtain an extremely bulky paper which is very permeable to air and the mechanical properties of which are average in conditioned state (20° C-65% relative humidity) and very good in wet state.

The following Table II summarizes the various values given in the foregoing Examples for the different parameters:

TABLE II

| EXAMPLE No | Type of polyolefin | $\overline{M}_n$ | $\overline{M}_w$ | Type of solvant | Concentration of solution (% by wt) | Geometry of the tube: Length | Diameter | Range of critical temperatures (° C) | Various |
|---|---|---|---|---|---|---|---|---|---|
| 1 | Polyethylene (PE) | 11 500 | 80 000 | Cyclohexane | 6 | 10 m | 4 mm | 78 - 82 | |
| 2 | PE | 11 500 | 80 000 | Commercial Hexane | 2 | 40 cm | 1.5 mm | 93 - 97 | Addition of Oppanol (%) B |
| 3 | PE | 11 500 | 80 000 | Cyclohexane | 1 | 40 cm | 2 mm | 78 - 82 | Cellulose fibers (1%) |
| 4 | PE | 11 500 | 80 000 | Cyclohexane | 1 | 40 cm | 2 mm | 78 - 82 | Cellulose fibers (0.5%) |
| 5 | Polypropylene (PP) | 28 000 | 45 000 | Heptane | 5 | 40 cm | 2 mm | 80 - 88 | |
| 6 | PE | 11 500 | 80 000 | Cyclohexane | 5 | 90 cm (3 zones) | 2 mm | 80 - 92 | |
| 7 | PE | 11 500 | 80 000 | Mixture | 5 | 90 cm (3 zones) | 2 mm | 95 - 102 | |

The following further Examples illustrate variations from the more typical numerical values given in Table II:

EXAMPLE IX

Example VI is repeated with a polyethylene ($\overline{M}n$ = 15300; $\overline{M}_w$ = 67,000).

The formation of fibers is noted within a range of critical temperatures of 80° to 85° C. The temperature of the fluids circulating around the tube in the three zones are respectively of 123°, 67° and 67° C.

EXAMPLE X

Example VI is repeated with another type of polyethylene ($\overline{M}_n$ = 28,000; $\overline{M}_w$ = 150,000).

The formation of fibers is noted between 90° and 102° C. The temperatures of the fluids around the tube in the three zones are respectively of 150°, 80° and 80° C.

EXAMPLE XI

A solution of 2% by weight of Vestolen 6016 (identical to the product of Example 1 of the application) in commercial cyclohexane is used. The tube is of stainless steel and has a length of 40 cm and a diameter of 2 mm (as in Example III). The critical temperatures range is in this case of 83° - 90° C.

Thus, it appears that the critical temperatures range may vary considerably. Typically this range appears to be from about 75° to about 105° C for polyethylene and polypropylene.

Referring next to FIG. 2, in this embodiment a storage tank 21 is fed via a line 28 with a polyolefin solution 29, which can be agitated by means of an agitator 26. The tank 21 is maintained under the pressure of an inert gas, such as nitrogen.

The polyolefin solution arrives via the line 20 at a pump 22 and then, via the line 32, at the portion 24 of said line which contains the restriction. After the solution has passed through the restriction — during which passage the fibers are formed — the solution containing these fibers feeds a fiber recovery enclosure 25, provided with an agitator 27 which is not operated during this phase. A portion of the solvent, which has been impoverished in polyolefins, may be recycled via the line 35 to the pump 22.

A second pump 23 may possibly be used to pass a part of the polyolefin solution, via the line 31, to the restriction, in in order to regulate the flow of fresh polyolefin solution into the line.

When sufficient fibers have been collected in the enclosure 25, they may then be recovered by filtration. In the particular case of the apparatus shown by way of example in FIG. 2, the applicants have found that, in general, the fibers have a tendency to collect around the agitator 27. At the end of the precipitation phase it is, however, sufficient to feed fresh solution to the enclosure 25 and then redisperse the fibers by operating the agitator. This suspension of fibers in the solvent is then withdrawn via the line 36, which leads to a simple filtration device, not shown, where the fibers formed are collected on a filter while the solvent is recovered. This special recovery stage does not constitute a limitation of the process. The process may, as a matter of fact, be carried out continuously, the emptying of the enclosure 25 being then effected continuously, as is also the final filtration stage.

The temperature of the solution near the restriction must be within the range of critical temperatures. In order to compensate for possible heat losses in the conduits 30, 31, and 32, the temperature in the storage tank 21 must be equal to or greater than the temperature in the vicinity of the restriction. The difference between these temperatures depends on the amount of the possible heat losses between the tank 21 and the orifice.

The temperature is less important in the fiber recovery enclosure 25. Of course, it must be below the temperature of solution of the polyolefin and will preferably be close to the temperature in the vicinity of the restriction, so as to avoid any redissolving of the precipitated fibers or any precipitation of polyolefin which has not precipitated upon passing the restriction. A portion of the polyolefin which was originally placed in solution, as a matter of fact, remains in solution, the yield of fibers being in general about 50 to 85%, referred to the total polyolefin introduced into the solvent.

The restriction, as indicated above, may be of variable geometrical configuration. As a matter of fact, it is sufficient that there be a decrease in cross section in the conduit through which the polyolefin solution flows (while within the zone of critical temperatures). In FIGS. 3, 4 and 5, embodiments of suitable orifices have been shown:

in the case of FIG. 3, a diaphragm 37 which defines a simple hole 38 is arranged in the portion 24 of the conduit 32;

in the embodiment shown in FIG. 4, the portion 24 comprises a nozzle 40 debouching on a flat base 41 via a hole 39 which constitutes the restriction, upon the passing of which the fibers precipitate;

in accordance with FIG. 5, the polyolefin solution flows in a tube 24 of diameter D, comprising a transverse partition 42 within which there is arranged an orifice 43 which constitutes the restriction. This orifice 43 may be assimilated to a very short tube of length *l* and diameter *d*. The lower limit of the length *l* is not critical, but the applicants prefer to operate with a length *l* which is greater than about 0.5 to 1 mm.

These embodiments of restrictions are, of course, not limitative and the man skilled in the art can easily find equivalents.

The concentration of the polyolefin in the solution will preferably be less than 10% by weight in the zone in which the restriction is located. The applicants have noted that the best results are obtained with concentrations of less than 1% by weight for the polyethylene.

The following example illustrates the precipitation of polyethylene fibers by passage through an orifice formed of a very short tube of a diameter less than that of the tube in which the polyolefin solution flows.

EXAMPLE XII

Solutions of polyethylene of a number average molecular weight close to 14,000 and of a weight average molecular weight of close to 160,000 are formed in cyclohexane. The fresh solutions contain 5 or 10% by weight polyethylene.

These solutions are subjected to flow in accordance with the invention within the circuit of FIG. 2, in which the restriction located at 24 is formed by the tube shown in FIG. 5 whose diameter D is equal to 4 mm. The orifice 43 itself has a diameter of 1.5 mm and its "length" 1 is between 1.5 and 2 mm. Immediately downstream of this restriction, the flow tube again assumes the diameter D and is provided with a jacket so as to maintain isothermal conditions in the fiber precipitation circuit.

Four temperatures are recorded:

T1: temperature of the solution in the tank 21;

T2: temperature of the solution immediately downstream of the pump 23, before introduction into the precipitation circuit;

T3: temperature of the solution immediately upstream of the restriction;

T4: temperature of the enclosure 25.

The respective rates of flow of the two pumps 22 and 23 are also measured, and one determines:

the concentration $C_f$ of the fresh polyethylene solution in the tank 21;

the concentration $C_p$ of the polyolefin solution in the line 32 immediately before the precipitation of the fibers.

The yield of fibers is also evaluated, namely the ratio:

$$R = \frac{\text{weight of fibers obtained}}{\text{weight of polyolefin placed in solution}}$$

All the results thus obtained have been set forth in Table III below.

TABLE III

| Test No. | Temperature in °C T1 | T2 | T3 | T4 | Rate of flow of the pumps in l/hr pump 22 | pump 23 | R% | Cf % | Cp % | Appearance of the fibers |
|---|---|---|---|---|---|---|---|---|---|---|
| 1 | 107 | 112 | 80 | 80 | 70 | 2.8 | 53 | 5 | 0.20 | average length |
| 2 | 106 | 113 | 81 | 80 | 70 | 2.8 | 70 | 5 | 0.20 | average length |
| 3 | 107 | 113 | 81 | 80 | 70 | 0.9 | 70 | 5 | 0.07 | average length |
| 4 | 107 | 112 | 80 | 80 | 70 | 2.8 | 65 | 5 | 0.20 | short |
| 5 | 107 | 112 | 81 | 80 | 70 | 2.8 | 65 | 10 | 0.40 | very short |
| 6 | 107 | 112 | 81 | 80 | 70 | 0.9 | 87 | 10 | 0.13 | |
| 7 | 107 | 113 | 81 | 80 | 70 | 2.0 | 70 | 10 | 0.30 | |
| 8 | 106 | 112 | 81 | 80 | 70 | 0.9 | 77 | 10 | 0.13 | very short |

The fibers obtained are then incorporated, for papermaking evaluation, in a cellulose printing/writing composition in a ratio of 20% by weight of synthetic fibers and 80% by weight of cellulose composition.

Representative samples of paper of 70 g/m² and 35 g/m² are produced.

The number of nodules observed is extremely small and the best results have been observed with the fibers of tests 6 and 8 of this last example.

We claim:

1. A process for manufacturing polyethylene or polypropylene fibers from a composition of said polyolefin dissolved in a diluent, which is cyclohexane, hexane, pentane, heptane, or mixtures thereof, at a concentration of about 1 to about 5% by weight, which fibers generally have a length of between 0.1 mm and 2 cm and a diameter of bundles of such fibers of between 5 μ and 200 μ, comprising flowing said composition through at least one elongated zone circumscribed by a stationery boundary having a length of about 40 cm to about 10 m and a diameter of about 1.5 mm to about 4 mm, said composition being brought down to a temperature range such that while in said zone said range is below the temperature of solution of said polyolefin in the molten state and within, but not below, the range of critical temperatures in which said polyolefin would remain dissolved under the given conditions and with the composition at rest but precipitates when subjected to shear; whereby polyolefin fibers are formed in said diluent, said range of critical temperatures being between about 78° C and about 102° C, said composition in said zone being flowed at a velocity greater than the velocity for the given conditions at which polyolefin powder would be formed with said fibers, and beyond said zone separating the fibers from a suspension in the still-liquid diluent.

2. A process according to claim 1, wherein the flow in said zone is effected isothermally or quasi-isothermally and the temperature of introduction of the composition into said zone is within the range of critical temperatures.

3. A process according to claim 1, wherein the flow in said zone is effected in a nonisothermal manner and the temperature of the composition decreases along said zone in the direction of flow.

4. A process according to claim 3, wherein the temperature of introduction of the composition into said zone is greater than the upper limit of the range of critical temperatures.

5. A process according to claim 1 wherein said composition contains from 0.5 to 10 parts of polyethylene of a density of more than 0.935.

6. A process according to claim 1, wherein said composition contains from 0.5 to 10 parts of polyethylene of a density of more than 0.935 in 100 parts of a diluent and furthermore contains an adjuvant means soluble in the diluent in an amount of between 0.1 and 50% of the polyethylene for increasing the viscosity of the composition.

7. A process according to claim 1 wherein said composition contains from 0.5 to 10 parts of polyethylene of a density of more than 0.935 in 100 parts of a diluent and furthermore contains a fibrous material which is insoluble in the diluent.

8. A process according to claim 1 wherein said composition contains polypropylene.

9. A process according to claim 1 wherein said composition contains 0.5 to 10 parts of polyolefin in 100 parts of a diluent and furthermore contains a fibrous material which is insoluble in the diluent.

10. A process according to claim 1, wherein said polyolefin is chosen from the group consisting of polyethylene having a density of at least 0.935, crystalline polypropylene, crystalline polybutene, and copolymers thereof.

11. A process according to claim 1, further comprising said elongated zone having at least one restriction.

12. A process according to claim 11, wherein said restriction is in the shape of a conical nozzle.

13. A process according to claim 11, wherein said restriction is formed of a diaphragm.

14. A process according to claim 11, wherein said restriction is in the form of a very short tube of an inside diameter which is smaller than said elongated zone.

15. A process according to claim 11, wherein said polyolefin is a polyethylene composition in a diluent containing less than 10% by weight of polyethylene.

16. A process according to claim 11, wherein said polyolefin is a polyethylene composition in a diluent containing less than 1% by weight of polyethylene.

17. A process according to claim 11, used in the manufacture of paper which includes said polyolefin fibers.

* * * * *